US008265320B2

(12) United States Patent
Datz et al.

(10) Patent No.: US 8,265,320 B2
(45) Date of Patent: Sep. 11, 2012

(54) LOUDSPEAKER

(75) Inventors: R. Michael Datz, Rochester, NY (US); James J. Cronmiller, Rochester, NY (US)

(73) Assignee: Star Headlight & Lantern Co., Inc., Avon, NY (US)

( * ) Notice: Subject to any disclaimer, the term of this patent is extended or adjusted under 35 U.S.C. 154(b) by 807 days.

(21) Appl. No.: 12/321,922

(22) Filed: Jan. 27, 2009

(65) Prior Publication Data

US 2010/0189295 A1 Jul. 29, 2010

(51) Int. Cl.
*H04R 1/20* (2006.01)

(52) U.S. Cl. ..... 381/341; 381/342

(58) Field of Classification Search ..... 381/337, 381/339–343; 181/152, 159, 177, 187, 188, 181/192, 193
See application file for complete search history.

(56) References Cited

U.S. PATENT DOCUMENTS

| | | | |
|---|---|---|---|
| 4,689,609 | A | 8/1987 | Ko et al. |
| 4,790,020 | A | 12/1988 | Lin |
| 4,847,590 | A | 7/1989 | Gosswiller |
| 4,893,343 | A | 1/1990 | Bader |
| 4,963,855 | A | 10/1990 | Kojima |
| 4,975,965 | A | 12/1990 | Adamson |
| 5,804,774 | A | 9/1998 | Ford et al. |
| 5,970,158 | A | 10/1999 | Beltran |
| 6,127,918 | A | 10/2000 | Lin |
| D453,306 | S | 2/2002 | Bekasi |
| 6,516,076 | B1 | 2/2003 | Marlin |
| D513,200 | S | 12/2005 | Lai |
| D514,010 | S | 1/2006 | Corrigan |
| D514,466 | S | 2/2006 | Lai |
| D514,973 | S | 2/2006 | Coward |
| D516,448 | S | 3/2006 | Lai |
| D518,023 | S | 3/2006 | Miller |
| 7,617,794 | B2 | 11/2009 | Chlystek |
| 2005/0276432 | A1 | 12/2005 | Hsieh |

*Primary Examiner* — Ramon Barrera
(74) *Attorney, Agent, or Firm* — Kenneth J. Lukacher; Martin Lukacher

(57) ABSTRACT

A loudspeaker for projecting siren and other warning signals which is compact to facilitate installation in emergency vehicles, and which provides a horn projector in the compact space. The loudspeaker has a support in which an electrically driven driver unit is mounted. A chamber providing a plurality of cyclonic or spiral paths for sound from the speaker is located at one end of the support as by being connected to the support or being a part thereof. The support has a plurality of passageways for sound from each of the paths to exit ports at an end of the support opposite to the end thereof attached to or having the chamber. The cyclonic paths and the passageways are of like length and taper so that the sound from the exit ports combined in reinforcing relationship and projects outwardly from the exit port end of the support. The support provides a recombiner for the sound propagating along the cyclonic paths and passageways to provide the effect of a long horn in the compact space.

26 Claims, 17 Drawing Sheets

LOUDSPEAKER

The present invention relates to loudspeakers having horns which project sound and which occupy a compact space, so as to be suitable for installation in an emergency vehicle. A loudspeaker according to the invention projects high intensity sound, providing warning signals in the form of message or siren signals outwardly from the vehicle. The sound is projected with desired frequency response and propagation characteristics in that the loudspeaker carries the sound generated by a driver over a plurality of paths, each of which defines a horn, and from the outputs of which paths the sound combines in phase thereby projecting the sound having the desired frequency response in a desired radiation pattern at high intensity.

Emergency vehicles such as police cars and motorcycles require sirens which project high intensity warning signals from the vehicle. Such sirens may also be used as loud speakers to send audible messages from the emergency vehicle. The space in the emergency vehicles is limited and it is desirable to locate such sirens behind the grill at the front of the vehicle as illustrated in Beltran (U.S. Pat. No. 5,970,158, issued Oct. 19, 1999), or in the case of a motorcycle on a bumper or fender thereof. The sound is produced by a speaker driver, which may have a voice coil connected to a piston, which is vibrated by electrical signals corresponding to the warning signals such as the siren or messages (e.g., announcements) to be projected. Such drivers are shown for example in the above cited Beltran patent and in Bader (U.S. Pat. No. 4,893,343 issued Jan. 9, 1990) and Ford et al. (U.S. Pat. No. 5,804,774 issued Sep. 8, 1998). In order to intensify the sound from the driver, horns have been formed into which the speaker driver projects its sound, such horns sometimes receive sound from the speaker drivers through spiral passageways, as shown for example in Ko et al. (U.S. Pat. No. 4,689,609, issued Aug. 25, 1987), and Lin (U.S. Pat. No. 6,127,918, issued Oct. 3, 2000). The problem remains to provide siren loudspeakers for projecting sound having desired frequency response characteristics at high intensity and in radiation patterns extending outwardly, which satisfy Society of Automotive Engineer (SAE) specifications for siren loudspeakers, and especially which are sufficiently small and compact to facilitate installation thereof in limited spaces afforded in emergency vehicles.

Accordingly, it is a principal feature of the present invention to provide an improved compact, horn loudspeaker.

It is a further feature of the present invention to provide an improved horn loudspeaker especially adapted for use in emergency vehicles, as a siren or other warning signal or audible announcement projector, which achieves high intensity sound in a desired radiation pattern from a compact space.

It is a still further feature of the present invention to provide an improved horn speaker which may be assembled from fewer parts than is the case in existing horn speaker designs, and especially where the parts may be principally of plastic materials and where the assembly of the parts may be carried out readily and at low manufacturing cost.

It is a feature of the invention to provide an improved loudspeaker which is an assembly including a speaker driver, a support for the speaker driver and a chamber in which the sound from the speaker driver travels outwardly in a plurality of cyclonic paths to passageways in the driver support surrounding the driver so that they combine at exit ports of the passageways in reinforcing relationship thereby providing a plurality of horns which handle the sound, in a compact space.

Briefly described, an improved loudspeaker provided by the invention utilizes a structure providing a support member which both supports a driver unit and has a plurality of horn passageways around the driver unit from which the sound leaves at exit ports in phase and therefor in reinforcing relationship to produce high intensity siren and other warning signal sound, such as announcements or other messages. The horns may be fed from a plurality of pathways in a chamber attached to or part of the support member. These pathways may be defined by a plurality of spiral, cyclonic passageways into input ends of which the sound from the driver unit is projected and separates into the plurality of spiral passageways which leave at the outlets of the passageways in circumferential spaced relationship so as to feed sound into corresponding ones of the horn passageways in the support member. The chamber and spiral passageways thereof may be provided by a molded plastic part. A housing having the horn passageways may also be a plastic part.

In accordance with some embodiments of the invention, the chamber with the cyclonic pathways may be closed off and connected to the support member by gaskets and a plate having openings corresponding in shape to the sound receiving, inlet ends of the horn passageways. The horn passageways are sealed by the gaskets.

In accordance with another embodiment of the invention, the support member provides the chamber with the spiral passageways at one end thereof which passageways communicate with the horn passageways having the exit ports at the opposite end of the support member. The support member is provided by a cup having a closed base with an opening therein. The driver unit is received inside the cup to project sound through the opening. A housing surrounding the cup defines, with the outside of the base of the cup, the chamber with the spiral passageways. The housing also defines the horn passageways with the outside of the cup. The housing and the cup form ducts which provide the horn passageways and the spiral passageways. The cup and the housing may be of plastic material connected in sealing relationship with sealing material to provide an integrated support member.

Openings may be provided in the support member for the passage of water, for example from snow falling on the assembled loudspeaker which falls into the passageways in the support member and is melted by heat generated by the driver. The support member provides the passageways carrying the sound produced by the driver. The sound produced by the driver passes through the horn passageways and is recombined so that the sound from each passageway recombines in reinforcing relationship and projects outwardly from the exit ports of the passageways. The support member, therefore, may be called a recombiner. Since the passageways provide extended horns and are afforded in the recombiner the horn speaker provided by the invention may be of compact size, and nevertheless projects sound in a desired radiation pattern.

The foregoing in other objects, features, and advantages of the invention will become more apparent through a reading of the following description in connection with the accompanying drawings in which.

Figure 8:
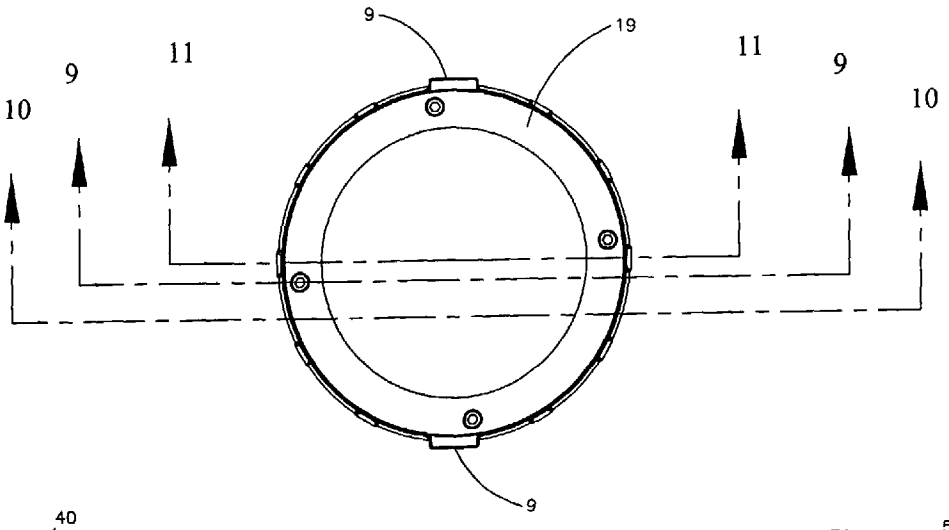
FIG. 8 is a bottom view of the assembled loudspeaker.
Figure 10:
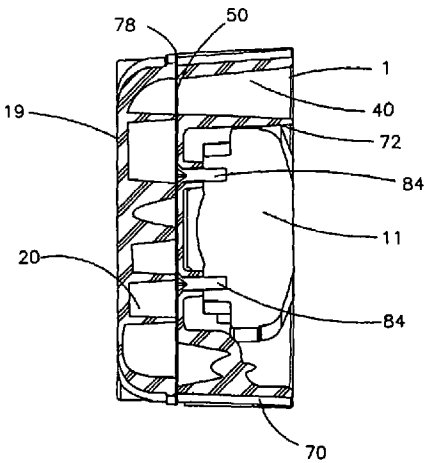
Figure 9:
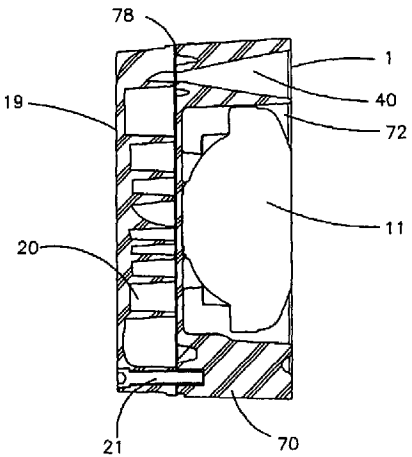
Figure 11:
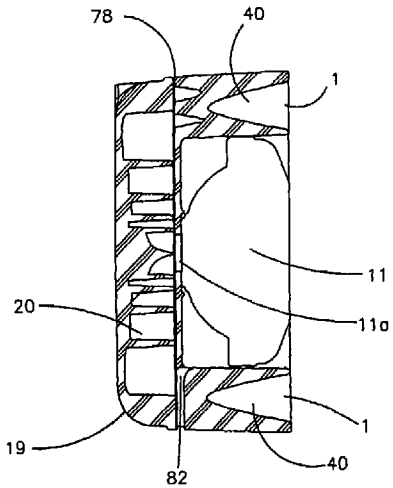
Figure 12:
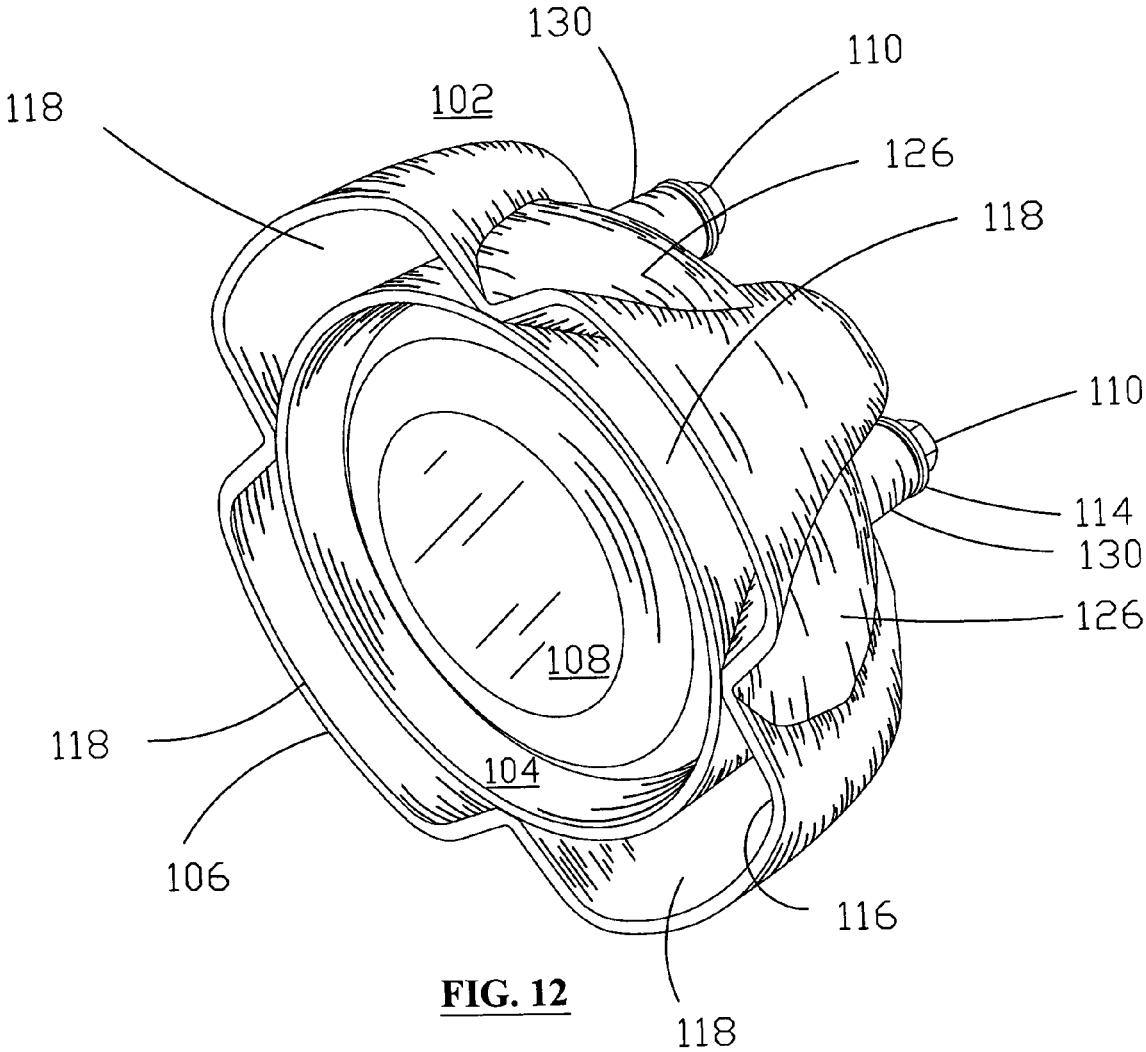
Figure 13:
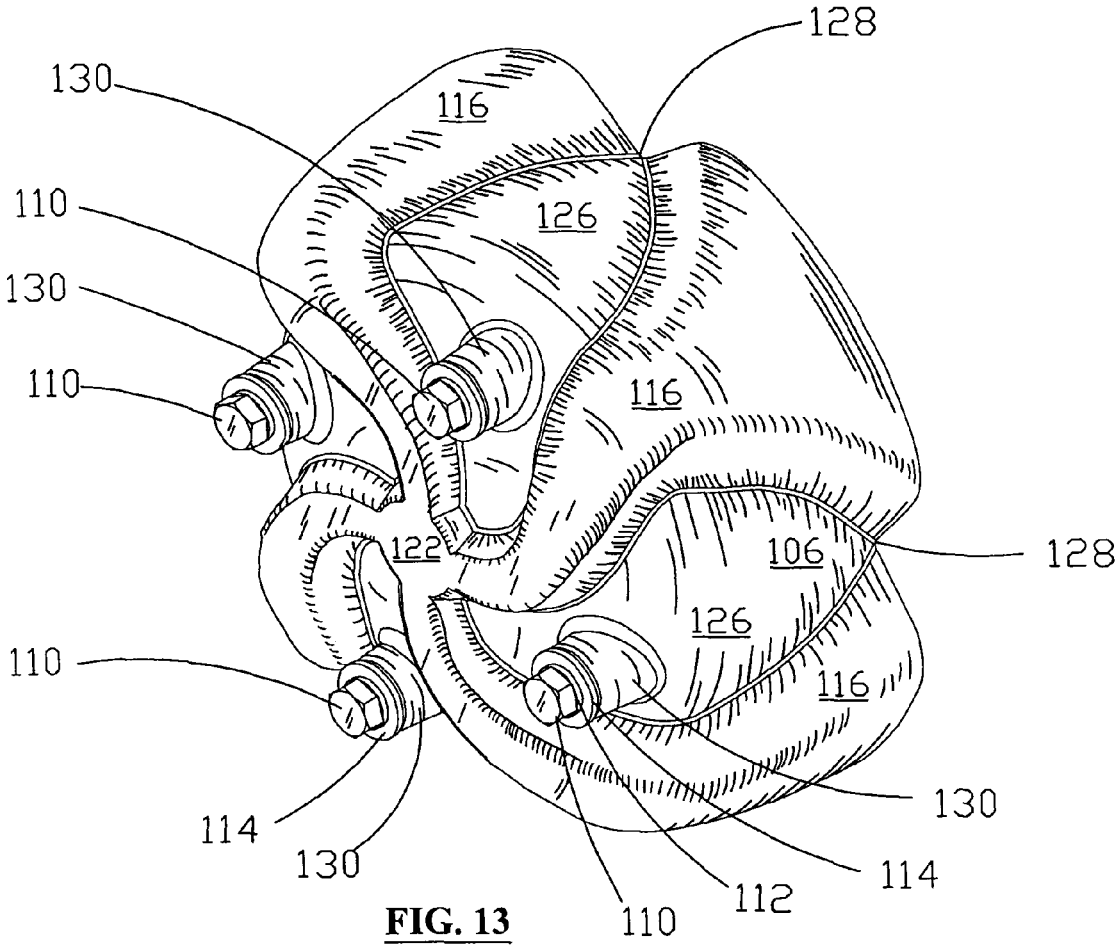
Figure 15:
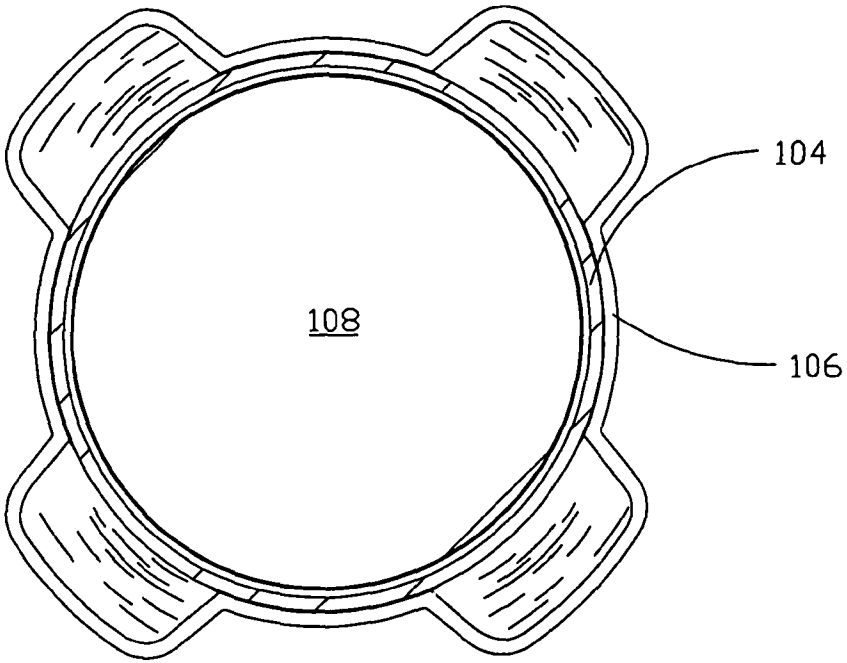
Figure 14:
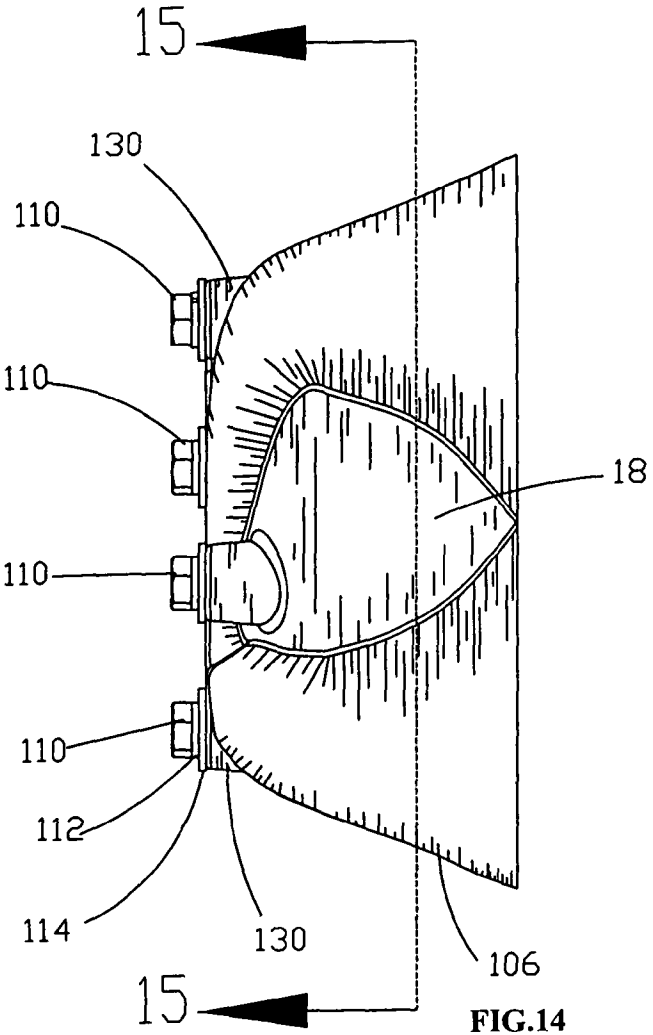
Figure 17:
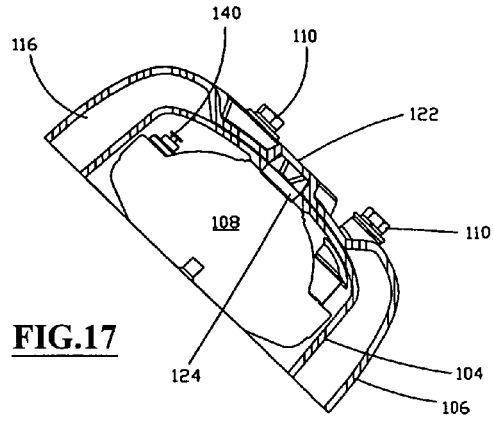
Figure 16:
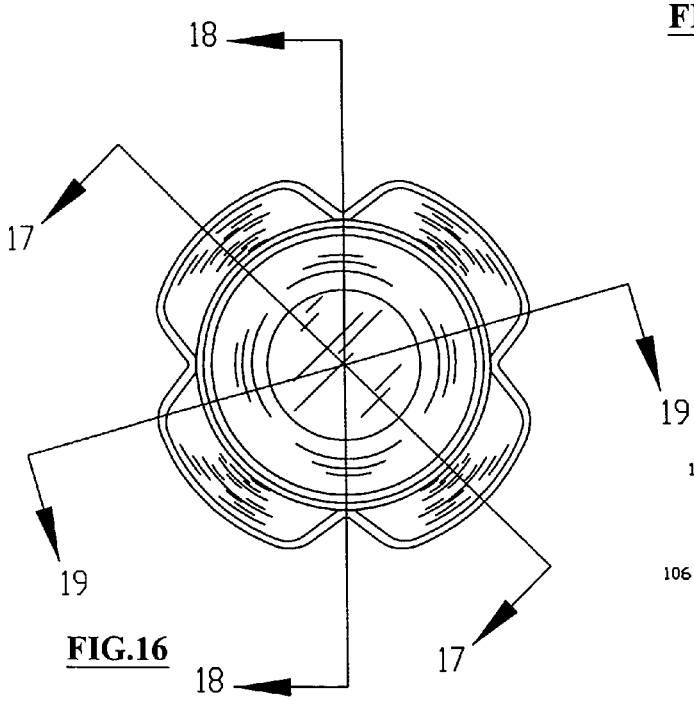
Figure 18:
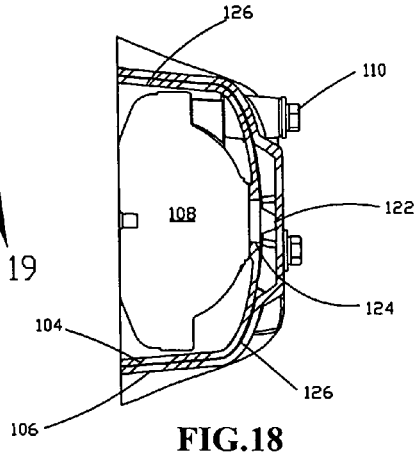
Figure 19:
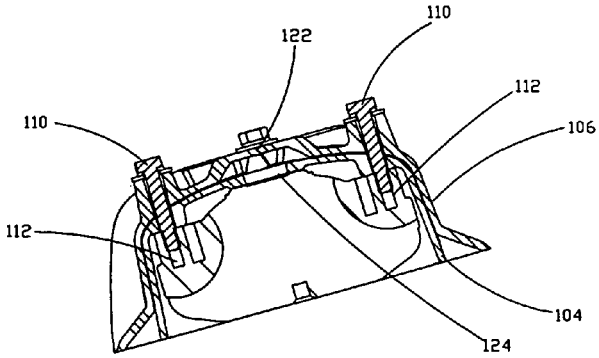
Figure 20:
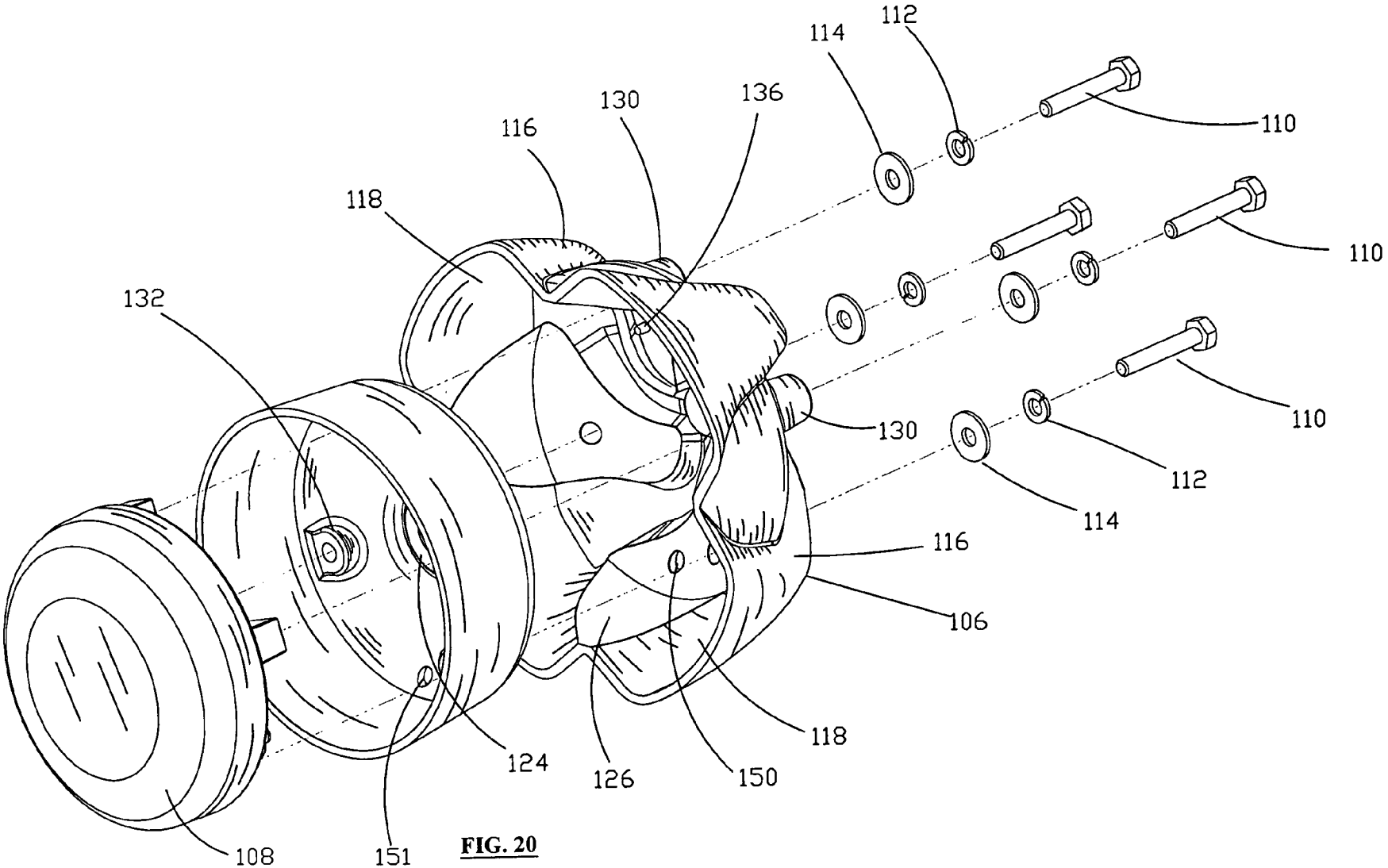
Figure 21:
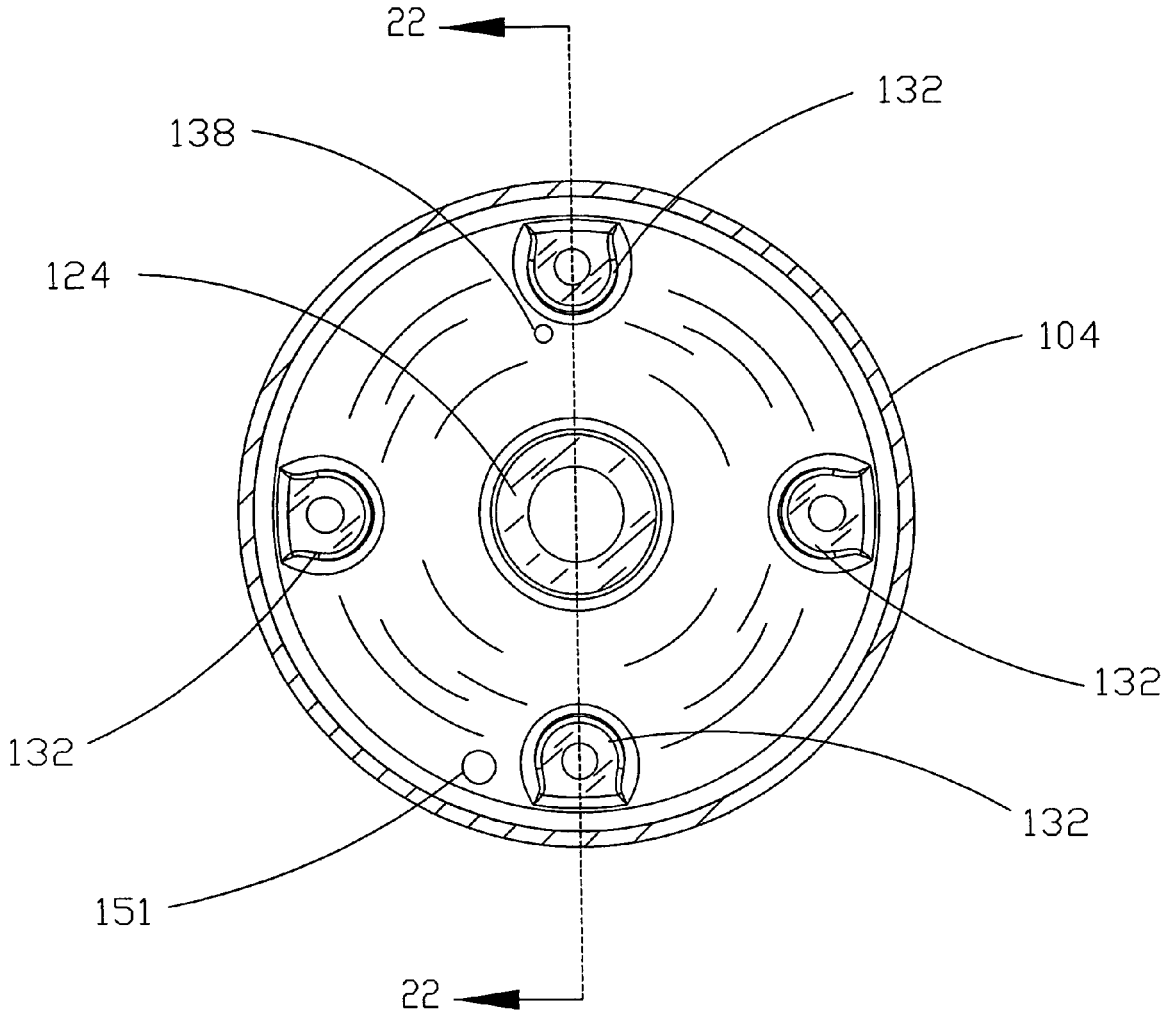
Figure 22:
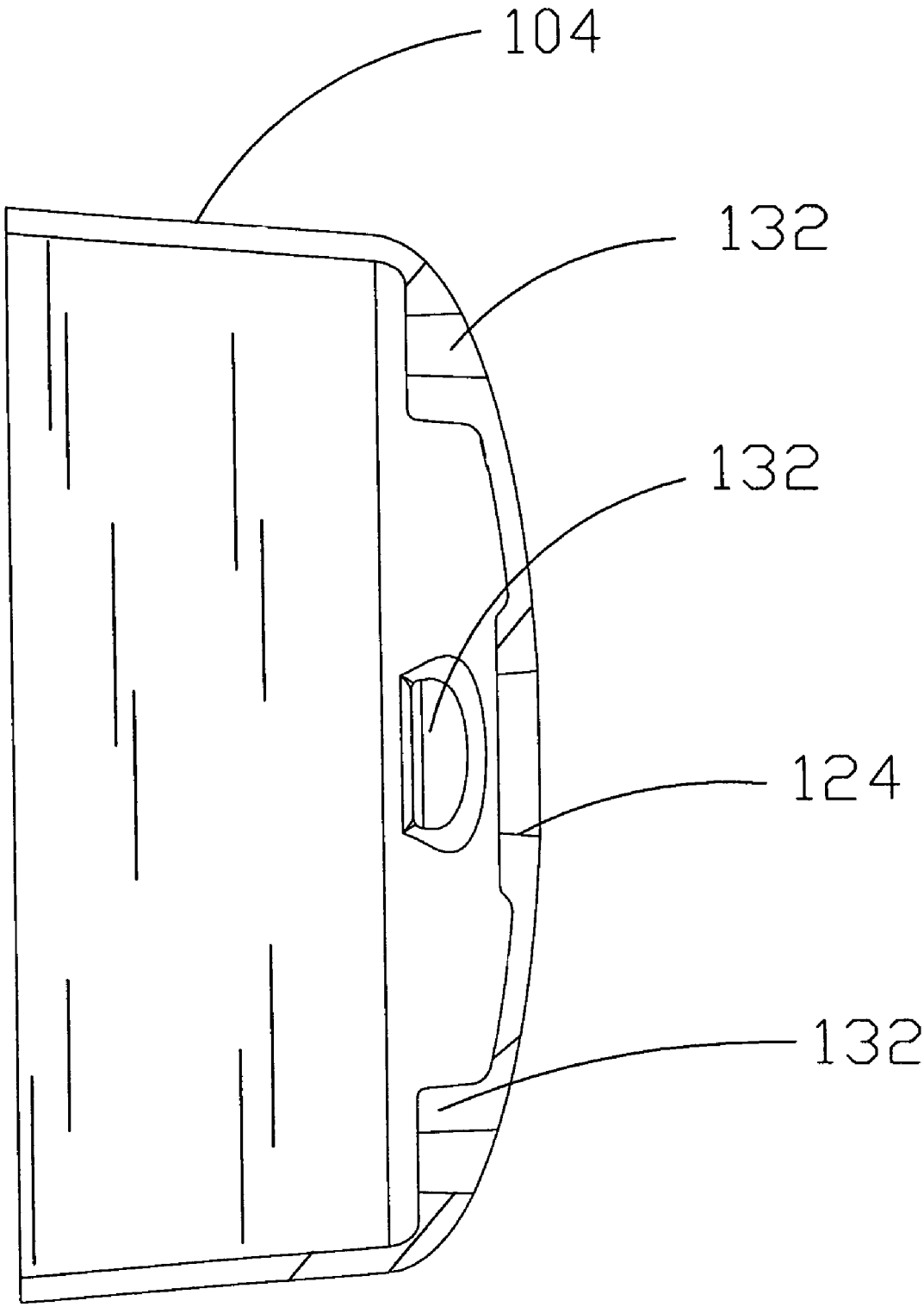
Figure 23:
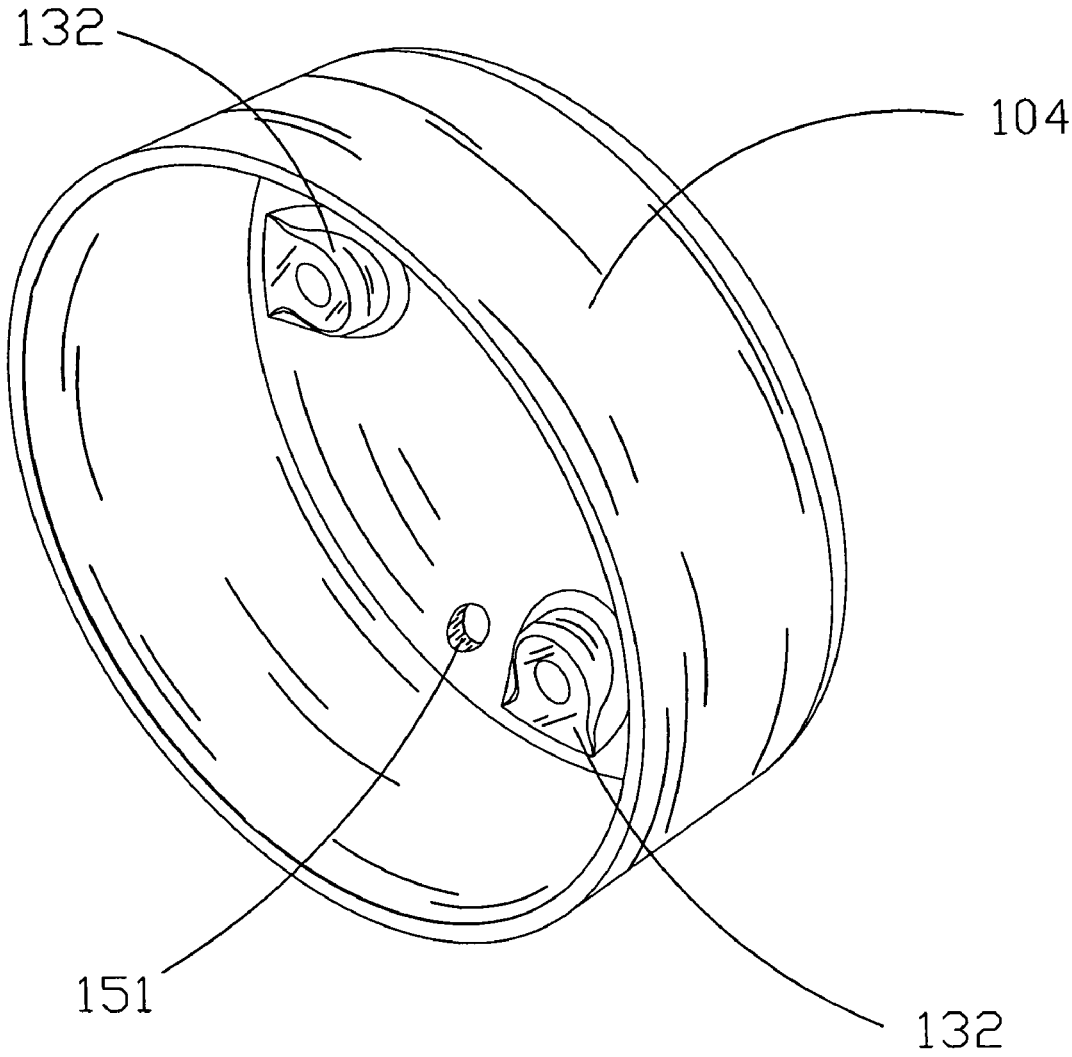
Figure 24:
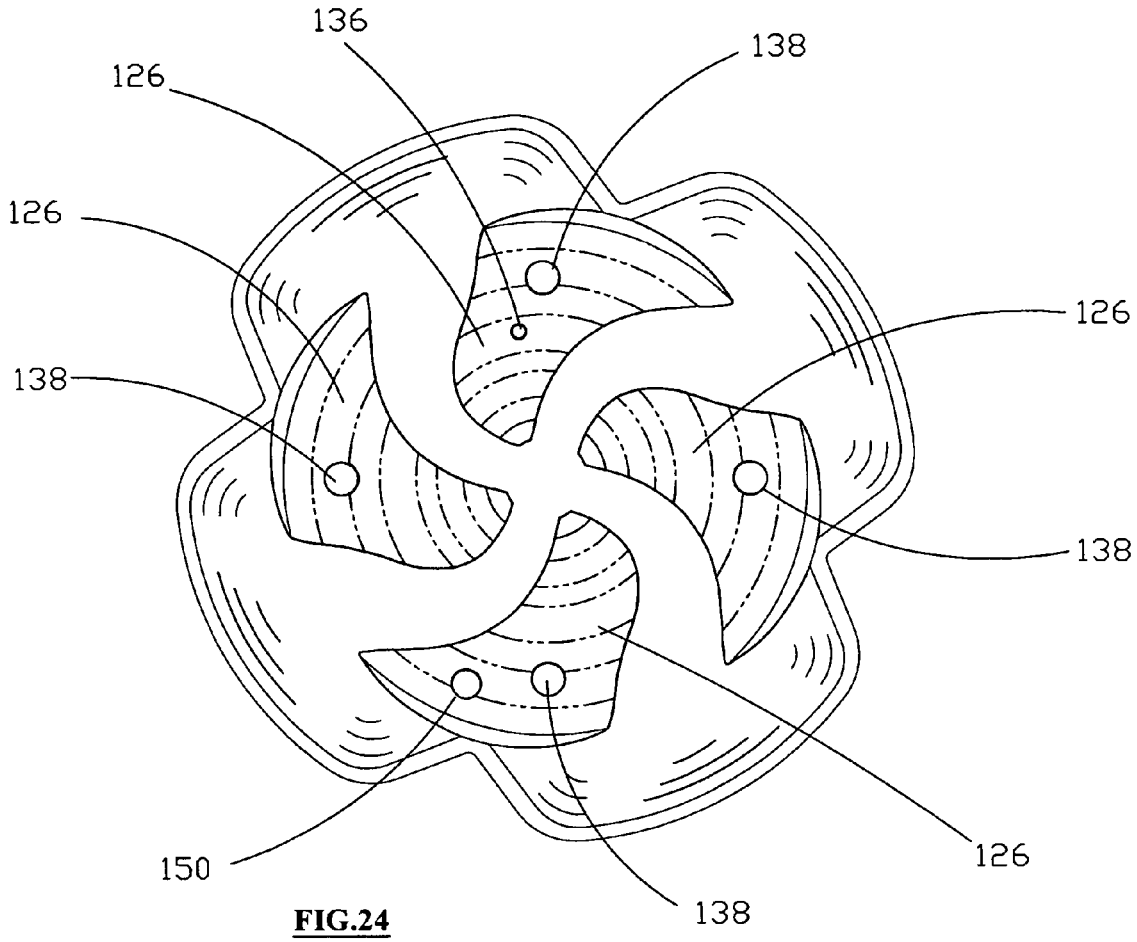

FIGS. 9, 10, and 11 are sectional views of the assembled loudspeaker taken along the lines 9-9, 10-10, and 11-11 in FIG. 8, the views being taken in the direction of the arrows at the end of these lines;

FIG. 12 is a perspective view of a loudspeaker in accordance with another embodiment of the invention, the view being taken from the front thereof where sound is projected away from the loudspeaker;

FIG. 13 is a perspective view of the loudspeaker shown in FIG. 12 taken from the rear thereof;

FIG. 14 is a side view of the loudspeaker;

FIG. 15 is a sectional view of the loudspeaker taken along the line 15-15 in FIG. 14, viewed in the direction of the arrows;

FIG. 16 is a top view of the loudspeaker taken from the left as viewed in FIG. 12;

FIGS. 17, 18 and 19 are sectional views taken respectively along the lines 17-17, 18-18, and 19-19, in FIG. 16;

FIG. 20 is an exploded perspective view showing the components of the loudspeaker illustrated in FIGS. 12-19;

FIG. 21 is a top view of the cup of the support member of the loudspeaker shown in FIGS. 12-20;

FIG. 22 is a sectional view of the cup taken along the line 22-22 in FIG. 21 when viewed in the direction of the arrows;

FIG. 23 is a perspective view from the front of the cup of the support structure shown in FIGS. 21 and 22; and FIG. 24 is a plan view of the housing of the support structure.

Referring to FIGS. 1-5, there is shown a driver unit 11 which projects sound by vibrating a piston 11*a* at the bottom thereof. This driver is of conventional design as shown in the above referenced patents, and may be selected from drivers commercially available, such as available from Federal Signal Corporation of University Park, Ill., U.S.A. The driver is operated by electrical signals from an amplifier or oscillator which may also be of conventional design. These electrical signals are connected by wires to a connecter 3. The wires from the connecter 3 may exit via a notch 10 in a support member which provides a recombiner 8, hereinafter called a support member recombiner. This support member has a central opening in which the driver 11 is secured. The support member recombiner 8 has a roof 8*a* which bridges the opening containing the driver 11 and is disposed at the upper or exit end of the support member recombiner 8. This roof 8*a* has a central hole through which a fastener screw 7 extends and is threaded into the top of the driver 11. The roof 8*a* may be optionally omitted, such that the driver 11 fills and seals the central opening through the support member recombiner 8. Another embodiment of the invention shown in FIGS. 6-11 omits the roof 8*a* and is discussed in detail hereinafter.

A central block off plate is provided by a blocking disc 14 (see especially FIG. 3) this disc has four bosses 15 which project therefrom and provide holes through which fastener screws 18 extend and may be threaded into the driver 11. The blocking disc 14 also has an orientation key 5 which facilitates the alignment thereof with the support member recombiner 8. The blocking disc 14 also clamps a gasket 12 between the blocking plate 14 and the outer edge of the bottom end 8*b* of the support member recombiner 8.

Figure 2A:
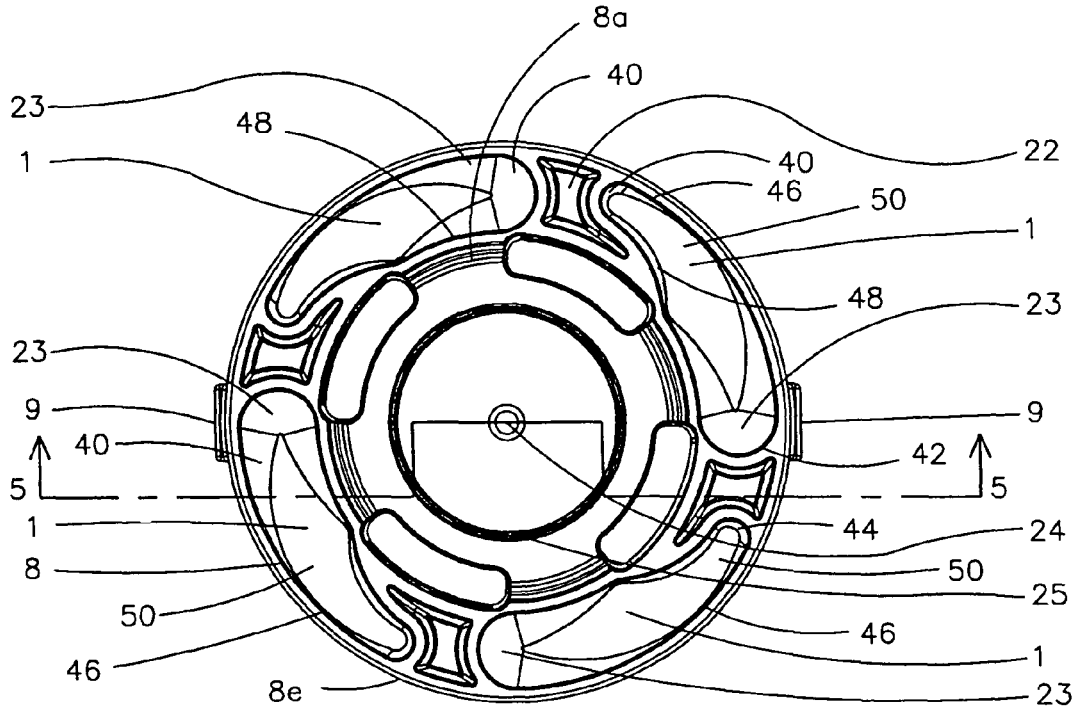
FIG. 2A is a top view of the assembled horn loudspeaker.
Figure 2B:
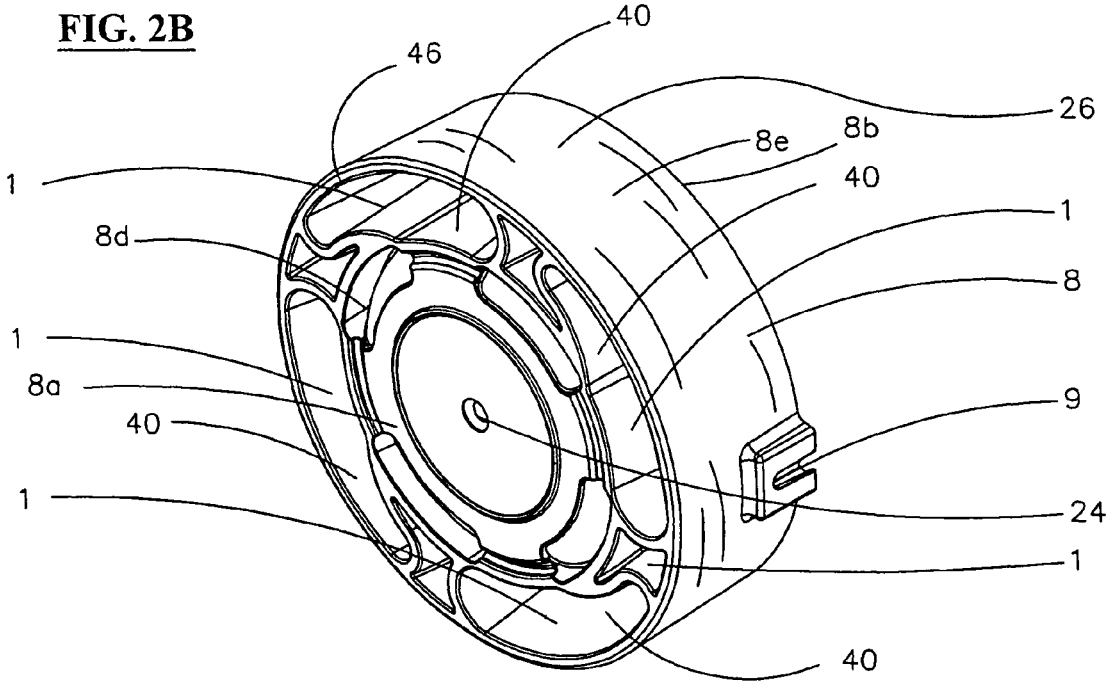
FIG. 2B is a perspective view taken from the top or sound exit end of the assembled horn loudspeaker.
Figure 3:
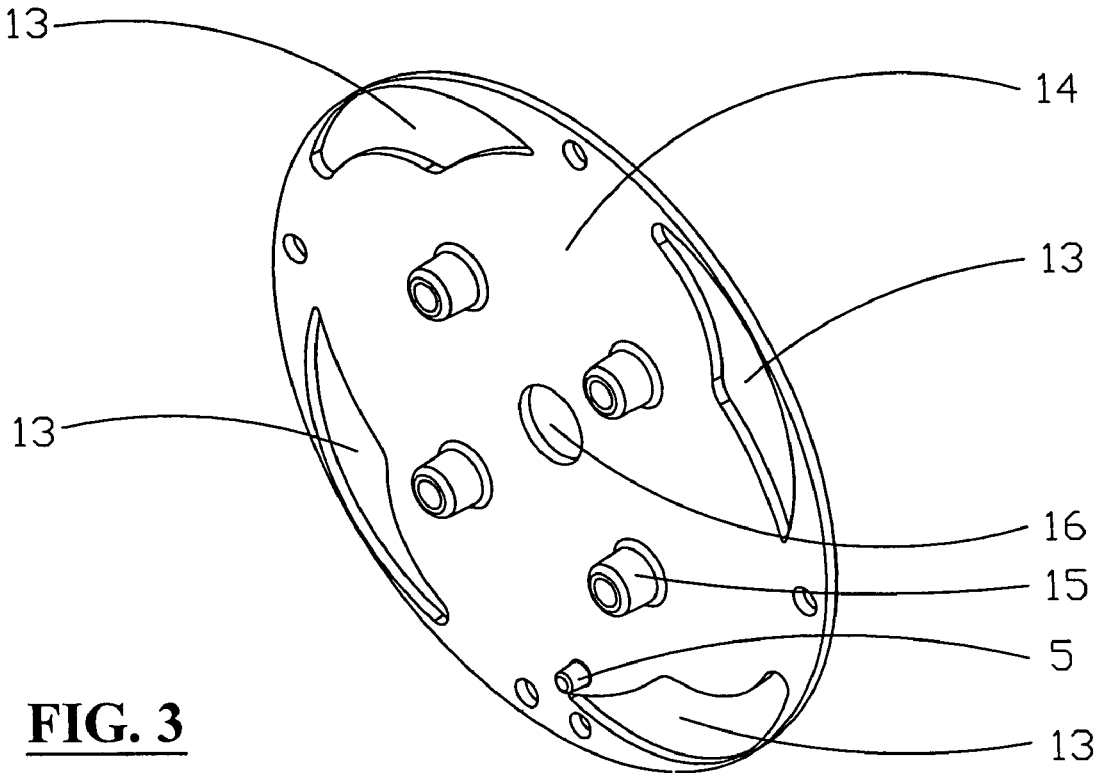
FIG. 3 is a perspective view of the block off disc plate which facilitates the closure of the plural cyclonic path chamber shown at the bottom or rear of the horn loudspeaker in FIG. 1.

The recombiner 8 is also shown in FIGS. 2A and 2B. It is a generally cylindrical structure having an interior opening 8*d* which is bridged by the roof 8*a*. The mounting hole 24 through which the fastener 7 extends and is screwed into the driver 11, as shown in FIGS. 2A and 2B but without the fastener 7 therein.

Circumferentially, angularly offset apart by 90° are four tapered passageways 40, these passageways are generally oblong in cross section and are disposed between the inside periphery 8*d* and the outside periphery 8*e* of the support member recombiner 8. The passageways have smooth arcuate surfaces defined by the walls thereof. Larger diameter and smaller diameter curved walls 42 and 44 are at opposite ends of the cross section of the passageways. The outside surfaces 46 of the passageways 40 are segments of a circle along the cross sections thereof. The inside surfaces 48 form two arcs and are generally scalloped in cross section. The shape of the exit ends or ports 1 and their angular offset determines the radiation pattern of the projecting sound. In the illustrated horn speakers, the shape of all the exit ports are alike and they have the same spacing, thereby providing a symmetrical or generally conical pattern.

The passageways 40 taper inwardly or decrease in cross section from their exit ports 1 to their bottom openings 50. In other words, the passageways expand as shown by the tapered portion of their wall 23 near the larger diameter curve ends thereof. Accordingly, the passageways 40 expand from the bottom to the top thereof at the exit end of the port member combiner and are therefore generally horn shaped. The shape of the walls and the top and bottom openings 1 and 50 of each of the passageways 40 are identical in shape. These shapes control the frequency response characteristics of the loudspeaker thereby avoiding distortion of the sound which passes through these passageways 40 to exit ports 1. The phase of the sound through each of the passageways is identical. Accordingly, the sound recombines so as to be projected in a direction away from the exit ports 1. The radiation pattern of the sound is also determines in part by the shape of the passageways 40 and particularly the shape of the exit port openings 1. The radiation pattern may be altered by changing the shape of the passageways and particularly the cross sections thereof.

The support member recombiner 8 may be molded from plastic materials, such as a high strength plastic suitably a polycarbonate plastic. In the course of molding in order to save plastic resin and to reduce the weight of the assembly, core out holes 22 may be provided between the passageways 40. Ears 9 for attaching the assembled loudspeaker driver project from the exterior wall, for mounting the entire horn loudspeaker assembly in an emergency vehicle or elsewhere where desired. The shape of the assembly may be enhanced by aesthetic fins which may be placed at 26 (See FIG. 6) along the outer periphery of the member 8.

The gasket 12 has through ports 4 of the same shape as the openings 50 at the bottom of the support member recombiner 8. Similar ports 13 are in the blockoff disc 14. The alignment of these ports 4 and 13 is facilitated by the orientation key 5.

The rear or bottom of the horn loudspeaker is provided by a cup shape chamber 19. This chamber has the cyclonic plenums 20 formed therein. The surface and upper edge of ribs forming the cyclonic plenums, which are four in number corresponding to the four horn passageways 40, have their upper edges in approximately the same plane indicated at the surface 52. See also FIGS. 4A and 4B. A gasket 17 between the blockoff plate 14 and the surface 52 seals the cyclonic plenums and separates the rear chamber 19 from the support member recombiner 8. The screws 18 assemble the rear chamber gasket 17, its disc plate 14, and the gasket 12, to the driver via holes 101 in the gasket 17 and the blocking disc 14 via the holes in the bosses 15 thereof.

The entire horn loudspeaker is assembled with main screw fasteners 21 which extend through holes 60 in the rear chamber which are diametrically opposite to each other, and through diametrically opposite holes 64 in the blocking disc plate 14 and the gaskets 12 and 17. The fasteners 21 engage threaded inserts 2 which are placed in the bottom of the support member, recombiner 8 adjacent to the core outs 22. An alignment pin 31 projecting from the surface 52 extends to an alignment hole 31*a* in the gasket 17 and a similar hole 31*a* in the blockoff plate 14. Since the openings 50 at the bottom of the passageways 40 and the openings 13 in the blocking disc 14 and openings 4 in the gasket 12 are all aligned with each other due to the use of the orientation key 5 and alignment pins 31, the entire horn loudspeaker will be readily assembled with the rear chamber 19 having the plenums 20. The rear chamber 19 may be a molded plastic part of the same plastic material as the support member recombiner 8.

The plenums 20 are each expanding horns having sound reflective surfaces 28 which direct the sound into the passageways 40 via the ports in the gaskets 12 and 17 and the ports 13 in the blocking disc 14. The output piston 11*a* of the driver 11 is aligned with throats 16 in the blockoff disc 14. The center of this throat, and of a corresponding hole in the rear chamber gasket 17, is disposed along the vertical axis of the horn loudspeaker, this axis is indicated by the line 100 in FIG. 1. The entrance ends of the cyclonic plenums 20 cross along the axis 100 and divide into four spiral or cyclonic plenums having evenly spaced wall surfaces 29. These surfaces are closer at the entry end of the plenums where they cross indicated as the throat entrance 30 in FIGS. 4A and 4B. The widest ends of the plenums are the sound reflective surfaces 28.

Figure 4A:
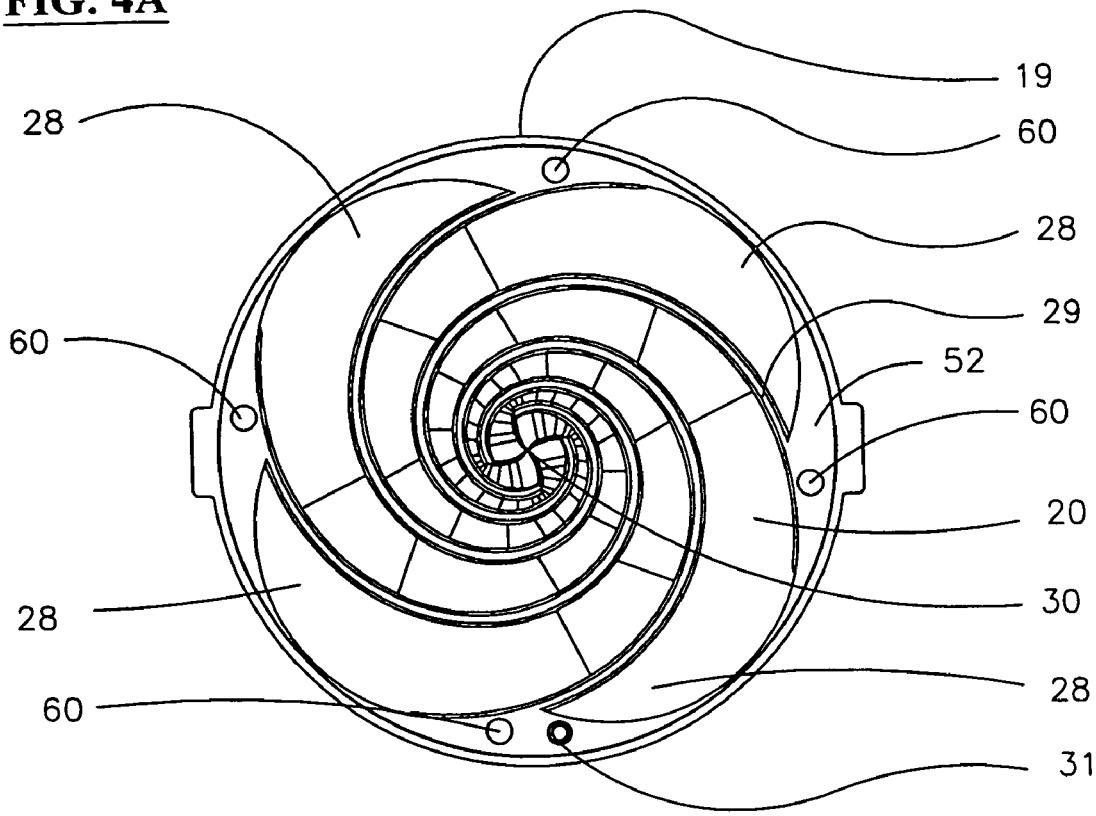
FIG. 4A is a top view of the plural path cyclonic chamber.
Figure 4B:
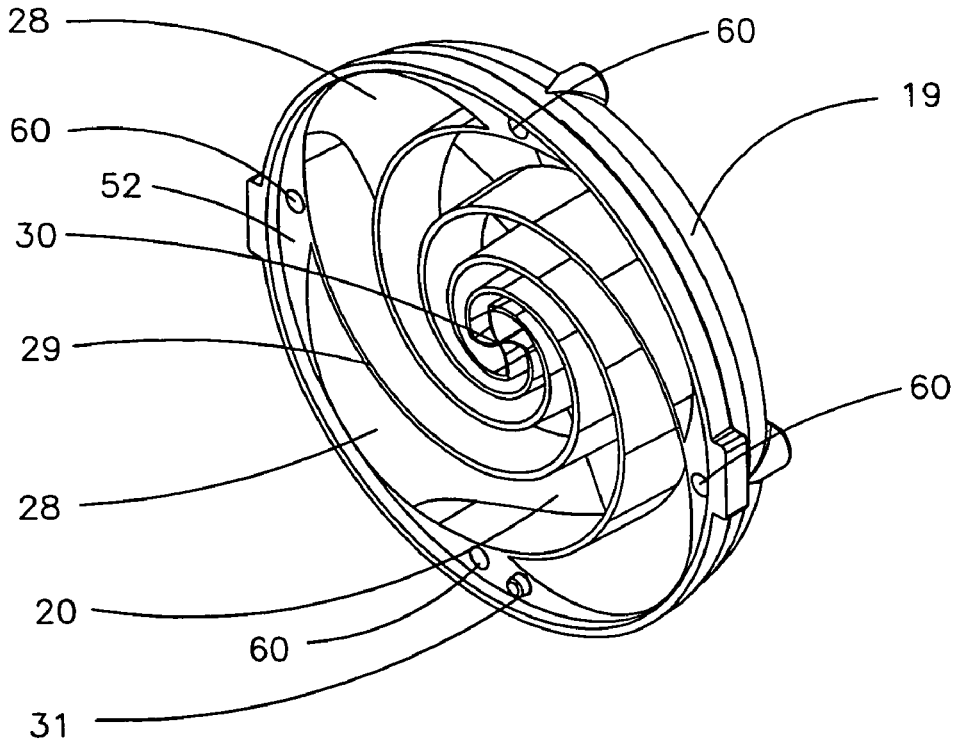
FIG. 4B is a perspective view of the chamber/taken from the front thereof.
Figure 5:
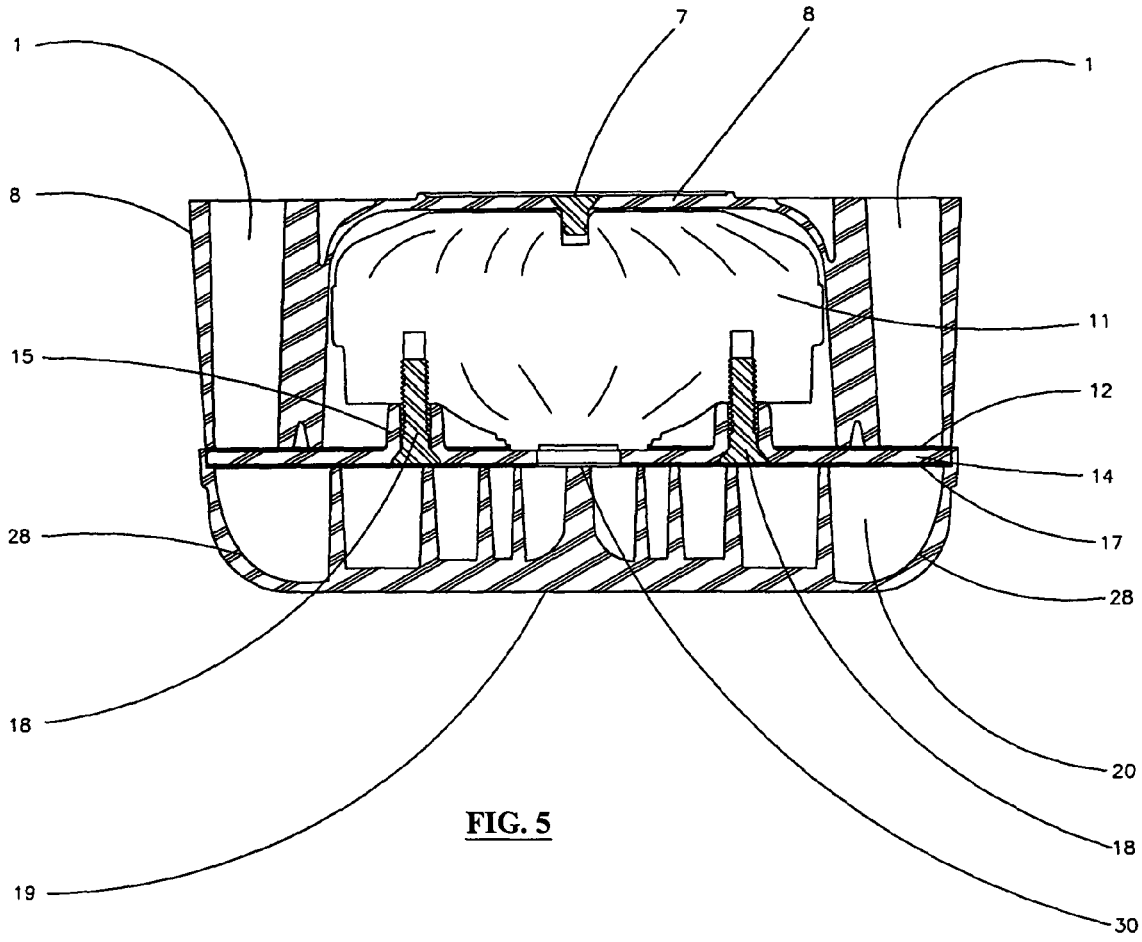
FIG. 5 is a sectional view of the assembled loudspeaker taken along line 5-5 in FIG. 2A
Figure 6:
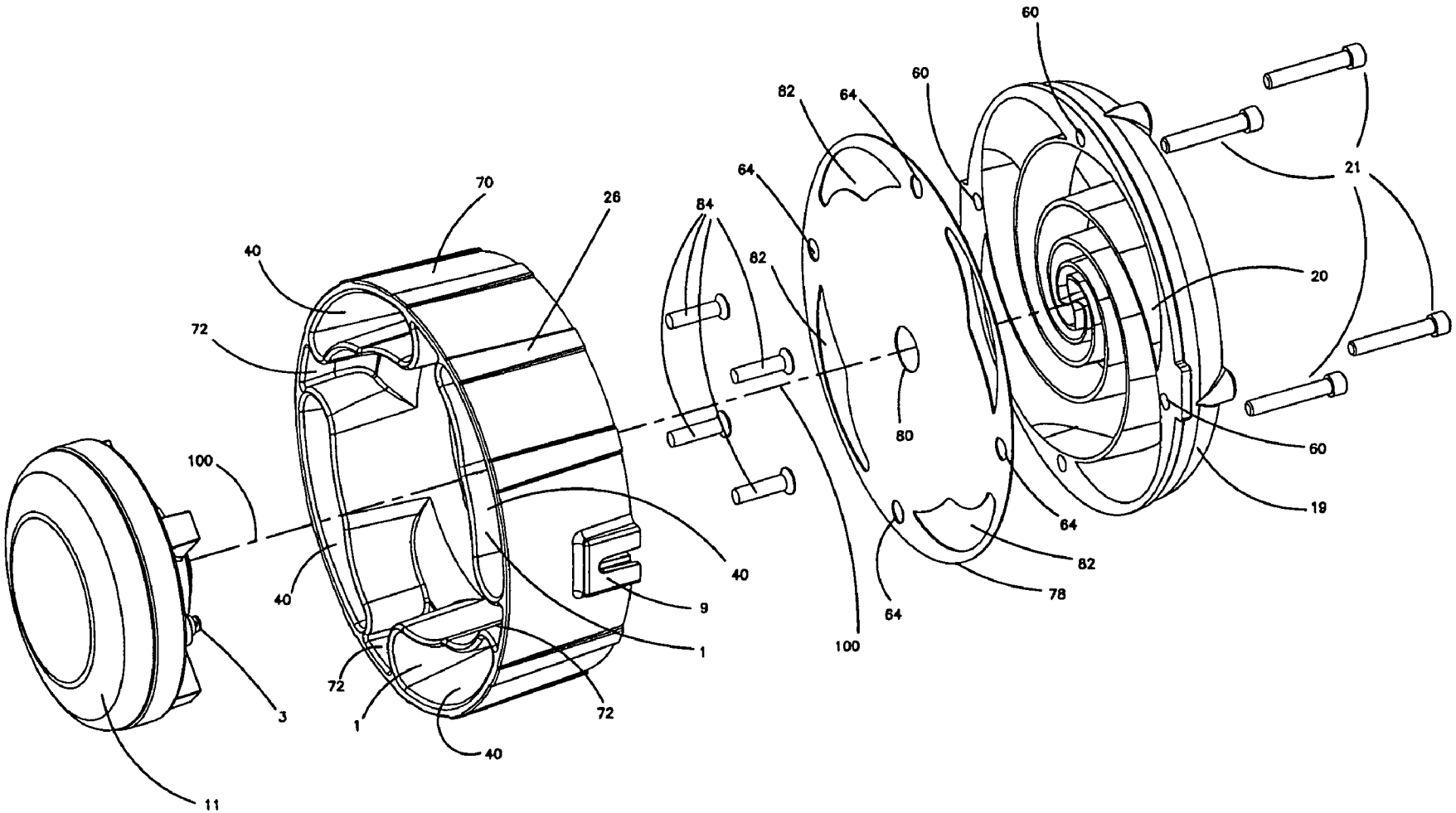
FIG. 6 is a perspective, exploded view of a horn loudspeaker provided by another embodiment of the invention.
Figure 7A:
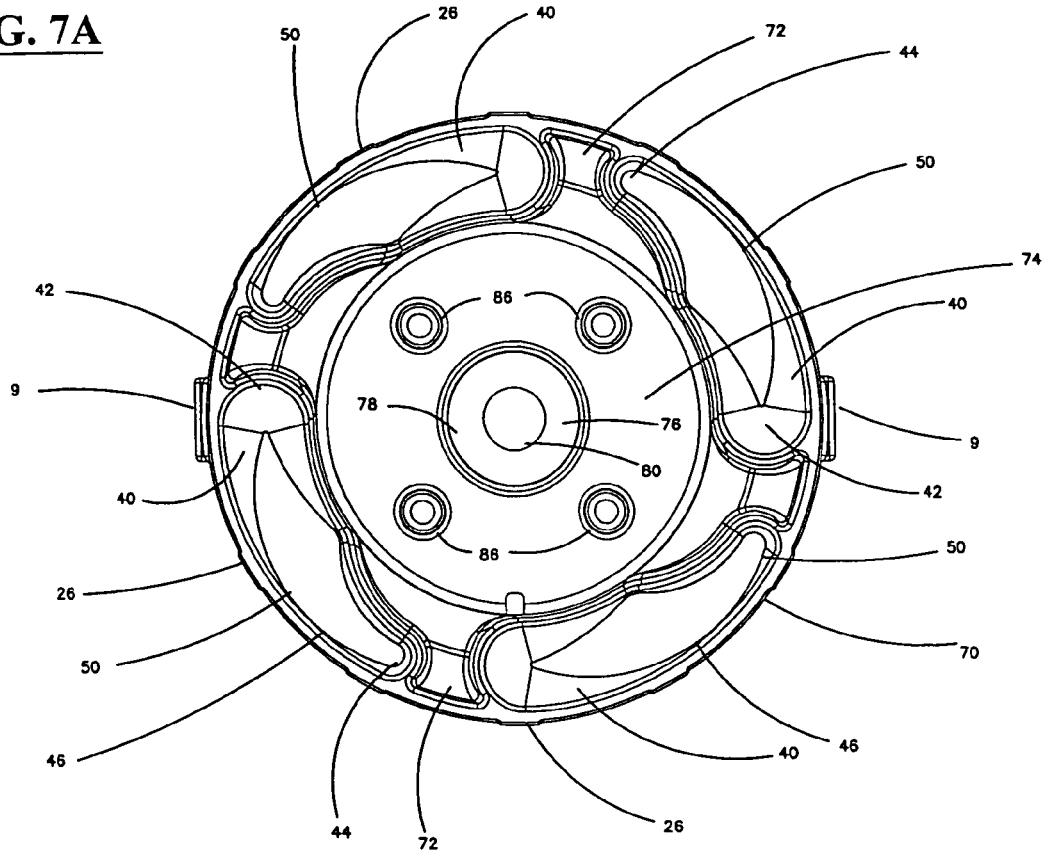
FIG. 7A is a top view of the support structure or recombiner component of the loudspeaker shown in FIG. 6.
Figure 7B:
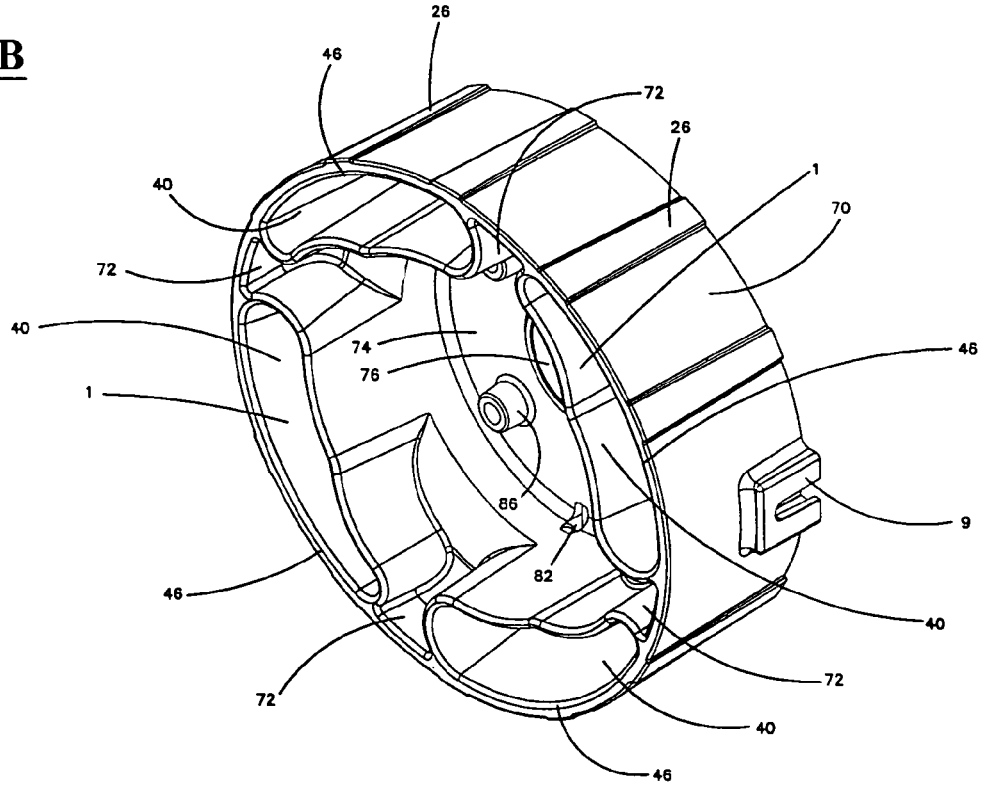
FIG. 7B is perspective view taken from the top or sound exit end of the component shown in FIG. 7A.

Accordingly, the cyclonic plenums are angularly displaced, circumferentially around the axis 100 (90° apart) until they reach the reflective surfaces 28 which are 90° apart as best shown in FIG. 4A. The floors of the plenums 20 may also be tapered downwardly from the blocking disc 14 (and the plane of the surface 52) thereby further expanding the sound until the sound waves hit the reflective surfaces 28. The length of the cyclonic plenums 20 is identical and their shape is identical so as to ensure that the sound from the driver unit 11 is carried along the plenums 20 and through the passageways 40 to the exit ports 1 without distortion or delays in propagation. The sound exiting the exit ports 1 and the horn loudspeaker assembly is in phase and in reinforcing relationship so as to project at high intensity to assure the perception of the sound by individuals in the entire vicinity of the horn loudspeaker, of the siren or other warning or enunciator (announcements or message) signals produced by the horn loudspeaker.

Referring to FIGS. 6-11, there is shown another embodiment of the horn loudspeaker which is similar to the embodiment illustrated in FIGS. 1-5 except for the driver support and recombiner component 70 and the omission of the arrangement of disk 14 and the gaskets 12 and 17. The plenum chamber 19 and the plenums therein are the same as illustrated in FIGS. 1, 4A, 4B, and 5 and the loudspeaker driver 11 is the same as in the embodiment described in connection with FIGS. 1-5. Like parts are identified with like reference numerals.

Figure 1:
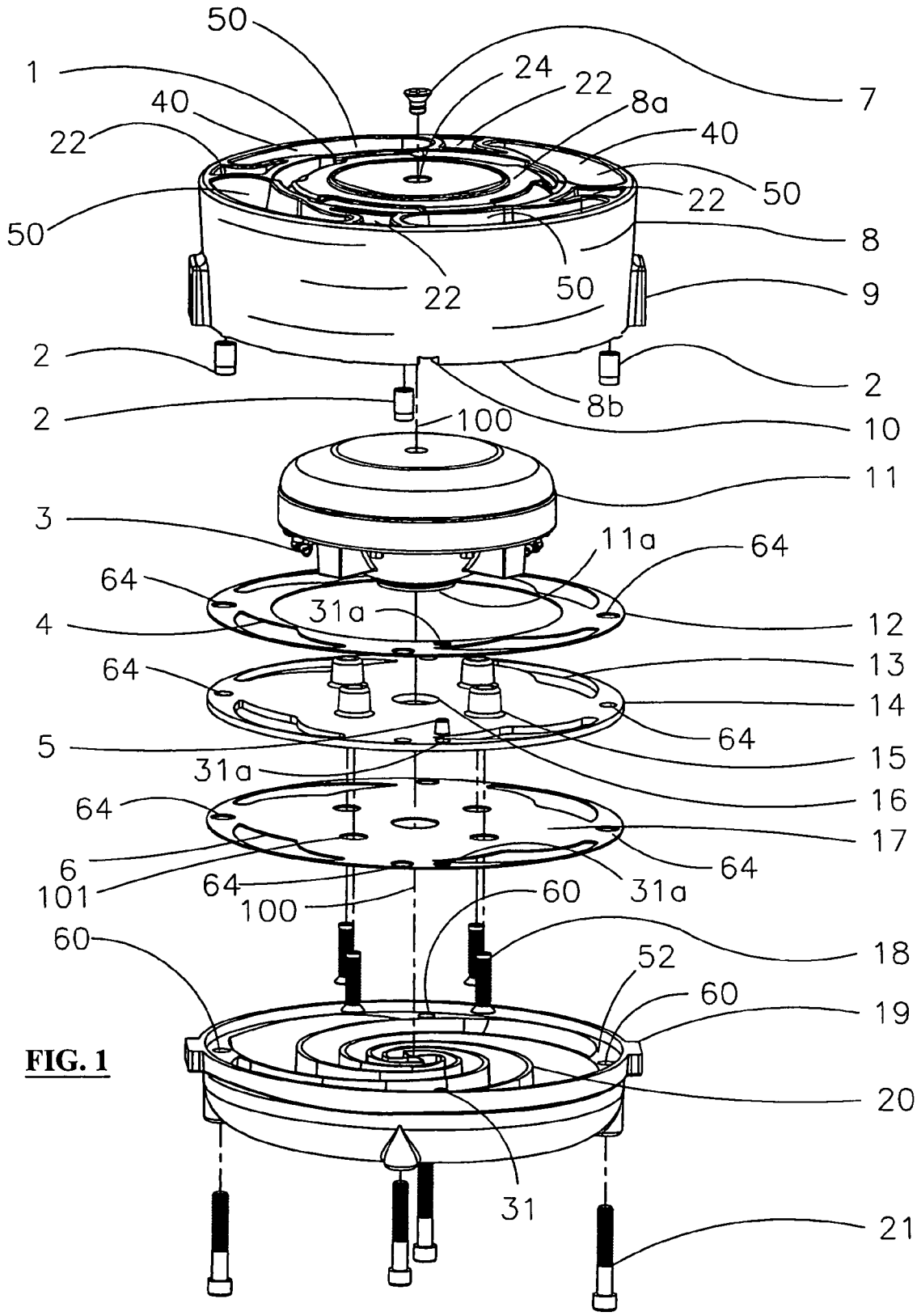
FIG. 1 is a perspective, exploded view of a horn loudspeaker provided by the invention.

The feature of the embodiment of the loudspeaker shown in the FIGS. 6-11 is the incorporation of ventilation space indicated at 72 around the driver 11 to facilitate cooling thereof in operation. Instead of a roof 8*a* as shown in FIG. 1, the interior of the support recombiner 70 has a bottom plate or disk 74 integral therewith, this plate has a central opening 76 for the output piston 11*a* of the driver 11.

Only one gasket 78 is used to sealingly connect the plenum chamber 19 to the recombiner support 70, this gasket has an opening 80 with its center along the axis 100 through which the sound from the driver piston 11 a enters the center of the plenum chambers 20. Screws 21 similar to those used in the embodiment shown in FIGS. 1-5 extend through holes next to the ears of the plenum chamber 19 which coincide with the ears 9 on the support 70. The gasket also has openings 82 coincident with the bottom ends 50 of the passageways 40 in the recombiner support 70 through which sound exiting the plenums enter the passageways 40 and expand and exit from the output ends 1 of these passageways 40.

The driver is connected by screws 84 which engage threaded holes in the driver after passing through bosses 86 in the bottom plate or disk 74 of the recombiner support 70. The wiring from the driver exits through a notch 82 (FIG. 7B) in the disk 74 which is aligned with the connecter 3 of the driver 11.

The loudspeaker shown in FIGS. 6-11 operates acoustically in the same way as the loudspeaker shown in FIGS. 1-5 and reference may be made to the sound handling operation and characteristics of the cyclonic plenums and the passageways to provide a compact horn loudspeaker.

Referring to FIGS. 12-24 there is shown a horn loudspeaker 102 in accordance with another embodiment of the invention. This embodiment provides the driver support and the chamber as an integral support member which may be assembled together utilizing a plurality of screws thereby minimizing the number of parts of the loudspeaker and facilitating the manufacture thereof. As shown in FIG. 12, the support member is provided by a driver cup 104 and a housing 106. The driver cup receives the driver 108. The driver 108 may be the same type of driver as the driver 11 used in the embodiments of the invention described above. The driver 108 is supported by the support member provided by the cup 104 and the housing 106. The driver 108 has threaded holes which receive screw fasteners 110 which are screwed into threaded holes 112 in the driver as shown in other figures, especially FIG. 19. These screws 110 clamp the housing 106 and the cup 104 together. The attachment is tight by virtue of the use of split washers 112 and flat washers 114, as shown in other figures, especially FIGS. 13 and 20.

The housing has horn passageways 116 provided by ducts open at exit ports 118. Extensions of these ducts in the base of the housing 106 provide the spiral passageways or cyclonic plenum of the loudspeaker. These passageways merge into a cylindrical stub sound receiving region 122 below an opening 124 in the base of the cup 104. The vibrating diaphragm of the loudspeaker 108 is positioned adjacent this opening and projects sound into the chamber 122 where it is distributed to the spiral passageways provided by the extensions of the ducts in the base of the housing 108. The ducts in the horn sections around the wall of the cup 104, increase in area thereby providing the horn passageways. The spiral passageways at the base also increase in area to effectively extend the length of the horn passageways much in the same way as the passages in the cyclonic plenum of the chamber shown in the embodiments of FIGS. 1-11.

There are regions 126, between the ducts 116, which conform to the cup. These regions taper downwardly from the exit end 128 of the housing 106. The cup and the housing fit together in these regions 126. A sealant or gasket material extending over these regions connects the cup 104 and the housing 106 in sealed relationship. Accordingly, the housing and the outside wall of the base and side of the cup form, with the housing 106, the ducts which provide the passages 116. A suitable sealant material may be a silicone glazing sealant, for example, sold under the trade name Boss by Accumetric, of Elizabethtown, Ky., USA.

To connect the driver 108 and the support member provided by the cup 104 and the housing 106 in assembled relationship with the screws 110, bosses 130 extend downwardly and outwardly from the housing 106 (see especially FIG. 14). There are holes through these bosses 130. There are also internal bosses 132 in the base of the cup 104 (see especially FIGS. 22 and 23). These bosses 130 and 132 have through holes for the screws 110 which are aligned when the cup 104 is aligned with the housing 118 with the aide of an alignment pin 136 in the housing 106 and an alignment hole 138 in the cup. Then the bolt is inserted through its washers 112 and 114 and the holes in the bosses 130 and 132 the threaded holes of the driver as shown best in FIG. 19.

The wiring to the driver 108 is connected to terminals 140 (see FIG. 17). This wiring exits the cup and the housing 106 via holes 150 and 138. These holes can also serve as drain holes for the loudspeaker 102.

The loudspeaker 102 has fewer parts than the speakers illustrated in connection with FIGS. 1-11 of the drawings. The loudspeaker 102 may also be similar in height and diameter than the speaker of FIGS. 1-11. Nevertheless, the support member for the driver provides the cyclonic plenum chamber as well as the horn passageways which are also present in the loudspeakers shown in FIGS. 1-11. The principal parts (the housing and cup providing the driver support structure may be structured plastic material, such as a polycarbonate plastic.

From the foregoing description, it will be apparent that there has been provided an improved loudspeaker, and particularly a horn loudspeaker especially suitable for use in emergency vehicles to project siren and other warning signals and other announcements. Variations and modifications in the herein described horn loudspeaker within the scope of the invention will undoubtedly become apparent to those skilled in the art. Accordingly, the foregoing description should be taken as illustrative and not in a limiting sense.

The invention claimed is:

1. A loudspeaker comprising a member providing a support for a sound producing driver, a plurality of passageways in said member around said driver and extending to exit ports, and said member having at an end thereof opposite to the end at which said exit ports are disposed a structure for delivering sound from said driver in a plurality of paths, each corresponding to a different one of said exit ports, said paths each communicating with a different one of said plurality of passageways, and wherein said structure contains a plurality of cyclonic plenums having input ends which divide sound from said driver into said plenums, said plenums having exit ends in communication with said passageways.

2. The loudspeaker according to claim 1 wherein each of said plenums has an expanding area and a reflective surface which deflects sound into said passageways, and the length of said plenums and said passageways, between said driver where said driver emits sound therefrom and each of said plurality of exit ports being identical so that sound is projected from said exit ports in phase and reinforcing relationship.

3. The loudspeaker according to claim 1 wherein each of said passageways expands in area from the input end thereof to the exit ports so as to provide horn effects.

4. The loudspeaker according to claim 1 wherein each of said passageways and said exit ports have a shape and spacing defining a desired radiation pattern for sound projected through said ports away from said exit ports.

5. The loudspeaker according to claim 1 wherein said cyclonic plenums are disposed in a chamber closed by a blocking plate connected to said support member, and said blocking plate being clamped between said chamber and said support member at the end thereof opposite to said exit ports.

6. A horn loudspeaker comprising:

a driver producing sound along an axis;

a plenum chamber having a plurality of spiral internal walls defining horns having input and output ends, the input ends being angularly offset from each other circumferentially around said axis and the output ends being angularly offset from each other circumferentially about said axis, said sound being divided at said input ends and propagated via said horns to said output ends; and a member providing a plurality of passageways generally along said axis, said passageways being in sound receiving relationship with said output ends of said horns, said passageways having exit ports for the sound from said horns, said exit ports being angularly offset circumferentially around said axis, the angular relationship and sound propagation path in said horns enabling sound provided by said driver via said horns and passageways to be combined in reinforcing relationship at said exit ports and projected away from said ports.

7. The horn loudspeaker according to claim 6 wherein said exit ports and passageways have cross sectional shapes and spacing providing a selected radiation pattern for sound projected from said exit ports.

8. The horn loudspeaker according to claim 6 wherein said member mounts said driver in a cylindrical opening therein extending along said axis.

9. The loudspeaker according to claim 8 wherein the walls at said output ends are bridged by reflective surfaces which reflect sound into said passageways.

10. The horn loudspeaker according to claim 9 wherein said passageways expand in area in a direction of said exit ports to provide horns which are extensions of horns formed by the spiral internal walls.

11. The loudspeaker according claim 10 wherein said passageways are defined by openings in said member having curved internal surfaces which extend said passageways, the curvature of each of said surfaces being generally the same.

12. The horn loudspeaker according to claim 6 wherein said chamber is generally cylindrical in shape and said member is generally cylindrical and having a generally circular opening in which said driver is mounted, said member and said chamber being connected to each other on opposite sides of a disc which blocks said chamber and defines a surface of said plenum chamber.

13. The horn loudspeaker according to claim 12 further comprising gaskets with openings corresponding to said passageways, said gaskets being disposed in scaling relationship with opposite sides of said disc.

14. The horn loudspeaker according to claim 13 further comprising openings along an edge of said cylindrical member for the passage of any liquid collected in the operation of said driver and releasing said liquid out of said closed cylindrical member.

15. The loudspeaker according to claim 6 wherein said chamber and member are parts of plastic material.

16. A method for producing sound from a sound producing driver of a loudspeaker comprising the steps of:

providing a plurality of spiral plenums for dividing sound from the driver; and providing a plurality of independent passageways for receiving sound separately from said spiral plenums and delivering said sound from the loudspeaker.

17. The method according to claim 16 further comprising the step of mounting said driver in a structure providing said spiral plenums and passageways.

18. The method according to claim 17 further comprising providing said structure by two plastic components and is assembling components together to locate said passageways around said driver.

19. The method according to claim 16 further comprising providing space between said passageways communicating in heat transfer relationship with said driver.

20. A loudspeaker comprising a member providing a support for a sound producing driver, a plurality of passageways in said member around said driver and extending to exit ports, and said member having at an end thereof opposite to the end at which said exit ports are disposed a structure for delivering sound from said driver in a plurality of paths, each corresponding to a different one of said exit ports, said paths each communicating with a different one of said plurality of passageways, and wherein said support and said structure are provided by a cup in which said driver is received, said cup having a base and a wall, a housing similarly cup shaped with a wall and a base, said housing wall and base having regions conforming to the wall and base of said cup and receiving said cup therein, and said housing having ducts between said regions, portions of said ducts being closed by said wall of said cup to define said passageways and being closed by said base of said cup to provide said paths.

21. The loudspeaker according to claim 20 wherein said portions of said ducts providing said passageways increase in area toward said exit ports to define horns.

22. The loudspeaker according to claim 20 wherein said base of said housing and said base of said cup define said structure.

23. The loudspeaker according to claim 22 wherein said ducts in said structure define a plurality of cyclonic plenums providing said paths, said paths having inlet ends arranged to receive sound from said driver.

24. The loudspeaker according to claim 23 wherein said ducts defining said cyclonic plenums increase in area from said inlet ends to said outlet ends thereof which communicate with said passageways.

25. The loudspeaker according to claim 20 wherein said driver, said cup and said housing are attached by screws extending through said bases of said housing and said cup to said driver and clamping them together.

26. The loudspeaker of claim 20 wherein said cup and said housing are of structural plastic material such as polycarbonate.

* * * * *